US009662877B2

(12) United States Patent
Matsuda

(10) Patent No.: US 9,662,877 B2
(45) Date of Patent: May 30, 2017

(54) INKJET HEAD AND INKJET PRINTER

(71) Applicant: KONICA MINOLTA, INC., Chiyoda-ku (JP)

(72) Inventor: Shinya Matsuda, Chiyoda-ku (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/902,483

(22) PCT Filed: Jul. 2, 2014

(86) PCT No.: PCT/JP2014/067627
§ 371 (c)(1),
(2) Date: Dec. 31, 2015

(87) PCT Pub. No.: WO2015/002220
PCT Pub. Date: Jan. 8, 2015

(65) Prior Publication Data

US 2016/0375682 A1 Dec. 29, 2016

(30) Foreign Application Priority Data

Jul. 2, 2013 (JP) ..... 2013-138995

(51) Int. Cl.
*B41J 2/045* (2006.01)
*B41J 2/165* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/14233* (2013.01); *B41J 2/165* (2013.01); *B41J 2202/12* (2013.01)

(58) Field of Classification Search
None
See application file for complete search history.

(56) References Cited

FOREIGN PATENT DOCUMENTS

| | | | | |
|---|---|---|---|---|
| JP | 10250110 A | * | 9/1998 | ..... B41J 2/14008 |
| JP | 2000-117993 | | 4/2000 | |
| JP | 2000-218788 | | 8/2000 | |
| JP | 2002-1951 | | 1/2002 | |

(Continued)

OTHER PUBLICATIONS

Kyoso, Tadashi (JP 2008254199 A—Machine Translation), Ink Jet Recorder, Oct. 23, 2008, Paragraphs 0025, 0060, 0078, 0083-0085, 0094, 0102-0105, 0118-0124.*

(Continued)

*Primary Examiner* — Lisa M Solomon
(74) *Attorney, Agent, or Firm* — Cozen O'Connor

(57) ABSTRACT

The flow path resistances of ink feeding holes (51, 52) of this pressure-type inkjet head (21) differ from each other. When ink is not being discharged, a driver circuit (46) generates a driving signal for circulating ink, which differs from a driving signal for discharging ink, and applies the driving signal for circulating ink to an actuator (32). The actuator (32) causes the flow rate of ink flowing from the respective ink feeding holes (51, 52) to differ between when ink is being drawn into a pressure chamber (31*a*) and when ink is being discharged from the pressure chamber (31*a*) and circulates the ink within the pressure chamber (31*a*) by being driven on the basis of the driving signal for circulating ink.

8 Claims, 10 Drawing Sheets

(56) References Cited

FOREIGN PATENT DOCUMENTS

| | | |
|---|---|---|
| JP | 2006-88493 | 4/2006 |
| JP | 2008-200902 | 9/2008 |
| JP | 2008-254199 | 10/2008 |
| JP | 2009-101516 | 5/2009 |
| JP | 2012-143980 | 8/2012 |

OTHER PUBLICATIONS

Machine Translation of JP-10250110A, Nakano, Takanori et al., "Ink Jet Recording Apparatus", Sep. 22, 1998, Toshiba Corp, [Paragraphs 0031-0035].*

* cited by examiner

INKJET HEAD AND INKJET PRINTER

RELATED APPLICATIONS

This is a U.S. National Phase Application under 35 USC 371 of International Application PCT/JP2014/067627 filed on Jul. 2, 2014.

This application claims the priority of Japanese application no. 2013-138995 filed Jul. 2, 2013, the entire content of which is hereby incorporated by reference.

TECHNICAL FIELD

The present invention relates to a pressure-type inkjet head that makes ink ejected from a pressure chamber by applying pressure to the ink in the pressure chamber by means of an actuator, and also relates to an inkjet printer including such an inkjet head.

BACKGROUND ART

There have conventionally been known inkjet printers including an inkjet head having a plurality of channels for ink ejection. Such conventional inkjet printers are capable of controlling ink ejection while moving the inkjet head relatively with respect to a recording medium such as a sheet of paper or cloth when outputting a two-dimensional image onto the recording medium. Such ink ejection can be performed, for example, by using a pressure-type actuator (such as a piezoelectric, electrostatic, or a thermal-deformation actuator), or by thermally forming a bubble in ink in a tube. Among such pressure actuators, piezoelectric actuators are advantageous in, for example, that it is large in output, capable of being modulated, high in responsiveness, and adaptable to any type of ink, and thus piezoelectric actuators have been widely used in recent years.

There are two types of piezoelectric actuators, one using a bulky piezoelectric body made by sintering, such as a ceramic tile, the other using a thin-film piezoelectric body (a piezoelectric thin film) formed on a substrate. The former has a large output and thus is capable of ejecting ink droplets of a large size, but it is large in size and high in cost. In contrast, the latter has a small output and thus is not capable of ejecting ink droplets of a large size, but it is small in size and low in cost. Thus, it can be said that actuators configured with a piezoelectric thin film are suitable to realize high-resolution (which can be achieved with small ink droplets) low-cost printers. Whether to use a piezoelectric thin film or a bulky piezoelectric body in a piezoelectric actuator may be decided in accordance with the usage of the actuator.

FIG. 15 shows a plan view illustrating a general configuration of an inkjet head 200 including a conventional piezoelectric actuator 101, and a sectional view of the inkjet head 200 taken along line A-A' in the plan view. The inkjet head 200 is configured with a head substrate 100 having a pressure chamber 100*a*, an actuator 101 arranged on one side of the head substrate 100, and a nozzle substrate 102 arranged on the other side of the head substrate 100. In the nozzle substrate 102, there is formed a nozzle hole 102*a* for controlling an amount of ink droplets. The nozzle hole 102*a* communicates with the pressure chamber 100*a*.

The actuator 101 is configured with a diaphragm (a driven film) 201, an insulating layer 202, a lower electrode 203, a piezoelectric body layer 204, and an upper electrode 205, laid one on top of another in this order from the head substrate 100 side. The lower electrode 203 and the upper electrode 205 are connected to a driver circuit 206. Furthermore, an ink feeding hole 301 for feeding ink from an unillustrated storage chamber into the pressure chamber 100*a* is formed through the diaphragm 201 and the insulating layer 202. The ink feeding hole 301 communicates with the pressure chamber 100*a* via a sub-chamber 100*b* formed beside the pressure chamber 100*a* in the head substrate 100.

In the above configuration, when voltage is applied to the lower electrode 203 and the upper electrode 205 from the driver circuit 206, the piezoelectric body layer 204 expands/contracts in a direction perpendicular to its thickness direction (that is, a direction parallel to the surface of the head substrate 100). The piezoelectric body layer 204 and the diaphragm 201 have different lengths, and this difference in length generates a curvature in the diaphragm 201, and as a result, the diaphragm 201 is displaced (curved) in its thickness direction. This up-and-down movement of the actuator 101 applies pressure to the ink introduced into the pressure chamber 100*a*, and thereby ink droplets can be ejected through the nozzle hole 102*a*.

This use of the actuator 101 in combination with the head substrate 100 and the nozzle substrate 102 makes it possible to form an ink channel (an ink ejection portion), and the inkjet head 200 is constituted by arranging such ink channels in length and width directions.

There are cases where foreign objects, such as waste generated during processing and assembly, may adhere to an inside of the inkjet head. There are also cases where the supplied ink includes foreign objects such as waste and flocculated particles. Furthermore, since the pressure chamber is in a negative pressure state after the ink is pushed out therefrom and ejected through the nozzle hole, air bubbles may be formed in the ink due to cavitation. With such foreign objects or air bubbles formed in an inside of the pressure chamber, the nozzle will be clogged up or pressure will be lost, and as a result, it becomes impossible to eject ink.

In order to remove such foreign objects and air bubbles from the inside of the pressure chamber, it is necessary to make ink in the pressure chamber circulate. In this regard, in Patent Literature 1, for example, a control mechanism (which includes a pump, a flow path, and a controller) is provided outside a head, and this control mechanism makes ink continuously circulate outside and inside the head.

CITATION LIST

Patent Literature

Patent Literature 1: Japanese Patent Application Publication 2009-101516 (claim 1, FIGS. 6 and 7, etc)

SUMMARY OF INVENTION

Technical Problem

However, with the configuration of Patent Literature 1, where the control mechanism for circulating ink is provided outside the head, a printer including the head becomes large in size as a whole, and thus becomes high in cost. Here, if an increased number of pressure chambers are provided to support higher-speed printing, the control mechanism provided outside the head will become accordingly larger in size and higher in cost. Moreover, if the pressure chamber is made small to support higher-resolution (higher-DPI (dot per inch)) printing, the flow path including an ink feeding hole also becomes small, and this will cause a greater resistance against circulation of ink, and thus an increased amount of pressure will be required to circulate ink. Such increase in amount of pressure may invite damage to the head or to the flow path, in addition to the increase in size and cost mentioned above.

The present invention has been made to solve these problems, and an object of the present invention is to provide an inkjet head that is capable of making ink in a pressure chamber circulate without additional provision of a dedicated control mechanism for circulating ink and thus is capable of avoiding increase in size and cost, and that is capable of supporting a high-speed and high-resolution printing with ease, and an inkjet printer including such an inkjet head.

Solution to Problem

According to an aspect of the present invention, an inkjet head is a pressure-type inkjet head that makes an actuator apply pressure to ink in a pressure chamber and thereby ejects the ink from the pressure chamber, and the inkjet head includes a plurality of ink feeding holes through which ink is supplied into the pressure chamber, and a driver circuit that generates a driving signal for driving the actuator. Here, the plurality of ink feeding holes have different flow-path resistances. When ink is not being ejected from the pressure chamber, the driver circuit generates, as the driving signal, a driving signal for circulating ink which differs from a driving signal for ejecting ink, and applies the driving signal for circulating ink to the actuator. By being driven based on the driving signal for circulating ink, the actuator makes ink in the pressure chamber circulate by making a flow amount of ink flowing through each of the plurality of ink feeding holes differ between when ink is drawn into the pressure chamber and when ink is discharged from the pressure chamber.

Advantageous Effects of Invention

According to the above configuration, when ink is not being ejected, an existing actuator, that is, an actuator for ejecting ink, is used also to circulate ink, and thus, in comparison with a conventional configuration where a dedicated control mechanism for circulating ink is additionally provided, the above-described configuration is capable of supporting high-speed printing and high-resolution printing more easily, avoiding increase in size and cost of inkjet heads.

DESCRIPTION OF EMBODIMENTS

Following below is a description of an embodiment of the present invention, with reference to the accompanying drawings.

[Configuration of Inkjet Printer]

Figure 1:
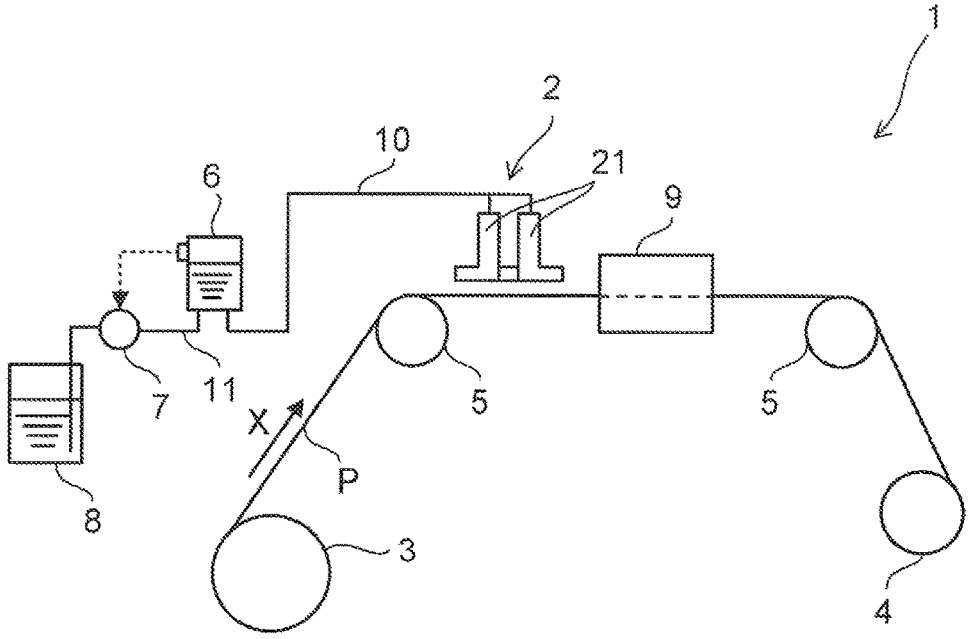
FIG. 1 is an illustrative diagram showing a general configuration of an inkjet printer according to an embodiment of the present invention.

FIG. 1 is an illustrative diagram showing a general configuration of an inkjet printer 1 of the present embodiment. The inkjet printer 1 is a so-called line-head type inkjet recording apparatus in which, inkjet heads 21 are linearly arranged in an inkjet head unit 2 along a direction of a width of a recording medium.

The inkjet printer 1 includes the inkjet head unit 2 described above; a feed roll 3, a wind roll 4; two back rolls 5, 5; an intermediate tank 6; a liquid-sending pump 7; a storage tank 8; and a fixing mechanism 9.

The inkjet head unit 2 performs image formation (image generation) based on image data by making the inkjet heads 21 eject ink toward a recording medium P. The inkjet head unit 2 is disposed close to one of the two back rolls 5, 5. A description will be give later of a configuration of the inkjet head 21.

The feeding roll 3, the wind roll 4, and each back roll 5 are each a cylindrical member rotatable around its axis. The feed roll 3 is a roll from which a long recording medium P, which is wound around the feed roll 3 in layers, is fed toward a position at which the recording medium P faces the inkjet head unit 2. The feed roll 3 feeds and transports the recording medium P in direction X shown in FIG. 1 by being driven to rotate by unillustrated driving means such as a motor.

The wind roll 4 winds the recording medium P around it after the recording medium P that has been fed from the feed roll 3 receives ink ejected from the inkjet head unit 2.

The back rolls 5, 5 are both disposed between the feed roll 3 and the wind roll 4. Of the back rolls 5, 5, one that is disposed on an upstream side in a transport direction of the recording medium P supports the recording medium P fed from the feed roll 3 on part of a peripheral surface thereof, and transports the recording medium P toward the position at which the recording medium P faces the inkjet head unit 2. The other one of the back rolls 5, 5 also supports the recording medium P on part of a peripheral surface thereof, and transports the recording medium P toward the wind roll 4 from the position at which the recording medium P faces the inkjet head unit 2.

The intermediate tank 6 temporarily stores ink supplied from the storage tank 8. The intermediate tank 6 is connected to a plurality of ink tubes 10. The intermediate tank 6 adjusts back pressure of ink in each inkjet head 21, and supplies ink to each inkjet head 21.

The liquid-sending pump 7 is adapted to supply ink stored in the storage tank 8 to the intermediate tank 6, and is disposed in a middle of a supply pipe 11. Ink stored in the storage tank 8 is pumped up by the liquid-sending pump 7, and is supplied into the intermediate tank 6 via the supply pipe 11.

The fixing mechanism 9 fixes, onto the recording medium P, the ink that has been ejected onto the recording medium P by the inkjet head unit 2. The fixing mechanism 9 is constituted by a heater for applying heat to the recording medium P to fix the ejected ink onto the recording medium P, a UV lamp for irradiating the ejected ink with ultraviolet rays to harden the ink, or the like.

In the above configuration, the recording medium P fed from the feed roll 3 is transported by the back roll 5 to the position at which the recording medium P faces the inkjet head unit 2, where ink is ejected from the inkjet head unit 2 onto the recording medium P. Thereafter, the ink that has been ejected onto the recording medium P is fixed by the fixing mechanism 9, and then, the recording medium P having the ink fixed thereon is wound up by the wind roll 4. Thus, in the line-head type inkjet printer 1, an image is formed on the recording medium P by ejecting ink onto the recording medium P while the recording medium P is being transported, with the inkjet head unit 2 remaining stationary.

Here, the inkjet printer 1 may be configured to form an image on a recording medium by means of a serial head method. The serial head method is a method that forms an image by ejecting ink onto a recording medium while transporting the recording medium and also moving an inkjet head in a direction perpendicular to the direction in which the recording medium is transported.

[Configuration of Inkjet Head]

Figure 2:
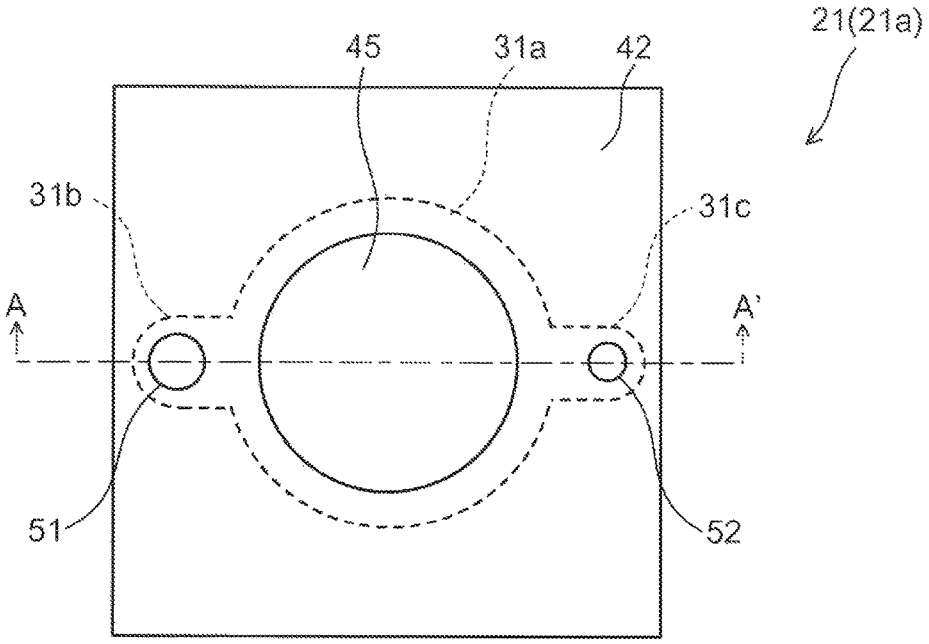
FIG. 2 shows a plan view showing a general configuration of a channel of an inkjet head incorporated in the inkjet printer, and a sectional view taken along line A-A' in the plan view.
Figure 2:
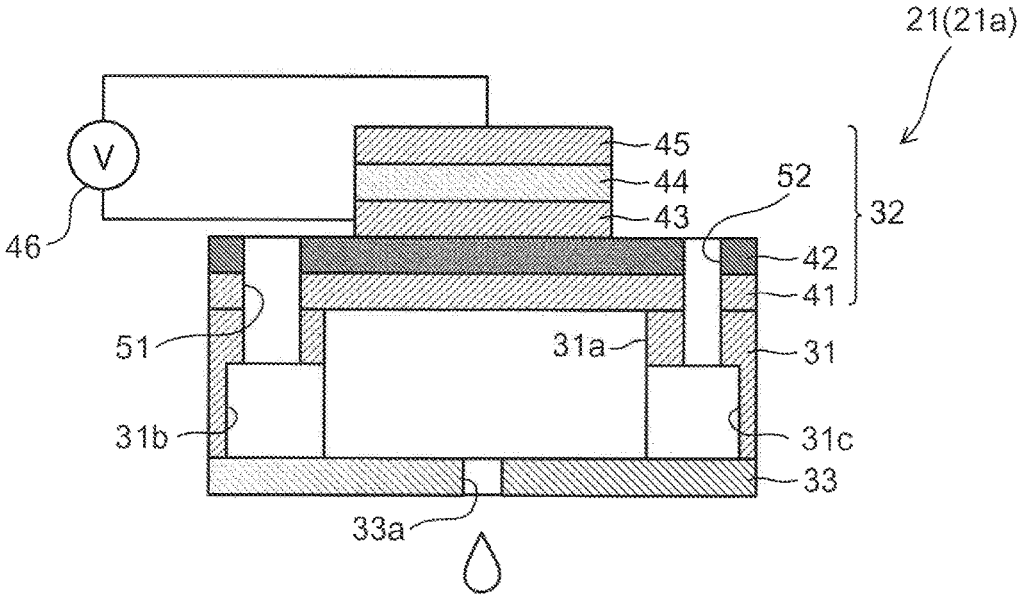

Next, a configuration of the inkjet head 21 will be described. FIG. 2 shows a plan view showing a general configuration of a channel (an ink ejection portion) 21*a* of the inkjet head 21, and a sectional view taken along line A-A' in the plan view. The inkjet head 21 is configured such that an actuator 32 is disposed on one side of a head substrate 31 formed of a silicon (Si) substrate, and a nozzle substrate 33 is disposed on the other side of the head substrate 31. In the head substrate 31, there is formed a pressure chamber 31*a* in which ink is stored. In the nozzle substrate 33, there is formed a nozzle hole 33*a* for controlling an amount of droplets. The nozzle hole 33*a* communicates with the pressure chamber 31*a*.

Furthermore, in the head substrate 31, there are formed a first sub-chamber 31*b* and a second sub-chamber 31*c* that communicate with the pressure chamber 31*a*. The first sub-chamber 31*b* is formed beside the pressure chamber 31*a*, in a portion of the head substrate 31 in a thickness direction of the head substrate 31. The second sub-chamber 31*c* is formed beside the pressure chamber 31*a* on a side opposite from the first sub-chamber 31*b*, in a portion of the head substrate 31 in the thickness direction of the head substrate 31. The first sub-chamber 31*b* and the second sub-chamber 31*c* are larger than later-described ink feeding holes 51, 52 in section but smaller than the pressure chamber 31*a* in section.

The actuator 32 has a diaphragm (driven film) 41, an insulating layer 42, a lower electrode 43, a piezoelectric body layer 44, and an upper electrode 45, which are laid one on top of another in this order from the head substrate 31 side. The lower electrode 43 and the upper electrode 45 are connected to the driver circuit 46, and disposed such that the piezoelectric body layer 44 is sandwiched between the lower electrode 43 and the upper electrode 45. The driver circuit 46 generates a driving signal for driving the actuator 32. The driving signal includes a driving signal for ejecting ink and a driving signal for circulating ink, details of which will be described later.

The diaphragm 41 decompresses or pressurizes an inside of the pressure chamber 31*a* by vibrating along with displacement of the piezoelectric body layer 44 caused by application of the driving signal to the piezoelectric body layer 44. The diaphragm 41 is formed of a silicon substrate. Here, the head substrate 31 and the diaphragm 41 may be integral with each other (that is, they may be formed of one sheet of silicon substrate), or may be formed as two silicon substrates that are joined together via an oxide film to form an SOI (Silicon on Insulator) substrate.

The insulating layer 42 is formed of a thermally oxidized film, such as silicon oxide ($SiO_2$), for example, for the purpose of protecting and insulating the diaphragm 41 or the head substrate 31. The lower electrode 43 is formed by stacking a titanium (Ti) layer and a platinum (Pt) layer, for example. The Ti layer is provided to enhance cohesion between the insulating layer 42 and the Pt layer.

The piezoelectric body layer 44 is a driving film (displacement film) operable to expand and contract in a direction perpendicular to its thickness direction, and is formed of a thin film of PZT (lead zirconate titanate), which is a solid solution of PTO ($PbTiO_3$; lead titanate) and PZO ($PbZrO_3$; lead zirconate), for example. Here, the piezoelectric body layer 44 may be constituted by a bulk. A lead-based or non-lead-based perovskite metal oxide may be used as a material constituting the piezoelectric body layer 44.

The upper electrode 45 is formed by stacking a Ti layer and a Pt layer. The Ti layer is provided to enhance cohesion between the piezoelectric body layer 44 and the Pt layer.

In the above configuration, when the driving signal is applied to the lower electrode 43 and the upper electrode 45 from the driver circuit 46, the piezoelectric body layer 44 expands/contracts in a direction perpendicular to its thickness direction. The piezoelectric body layer 44 and the diaphragm 41 have different lengths, and this difference in length generates a curvature in the diaphragm 41, and as a result, the diaphragm 41 is displaced (curved) in its thickness direction. This up-and-down movement of the actuator 32 (in particular, the diaphragm 41) applies pressure to the ink that has been introduced into the pressure chamber 31*a*, and as a result, ink droplets are ejected through the nozzle hole 33*a*.

Thus, in the present embodiment, the inkjet head 21 is configured as a pressure-type inkjet head where the actuator 32 applies pressure to ink in the pressure chamber 31*a* to eject ink from the pressure chamber 31*a* via the nozzle hole 33*a*.

Figure 3:
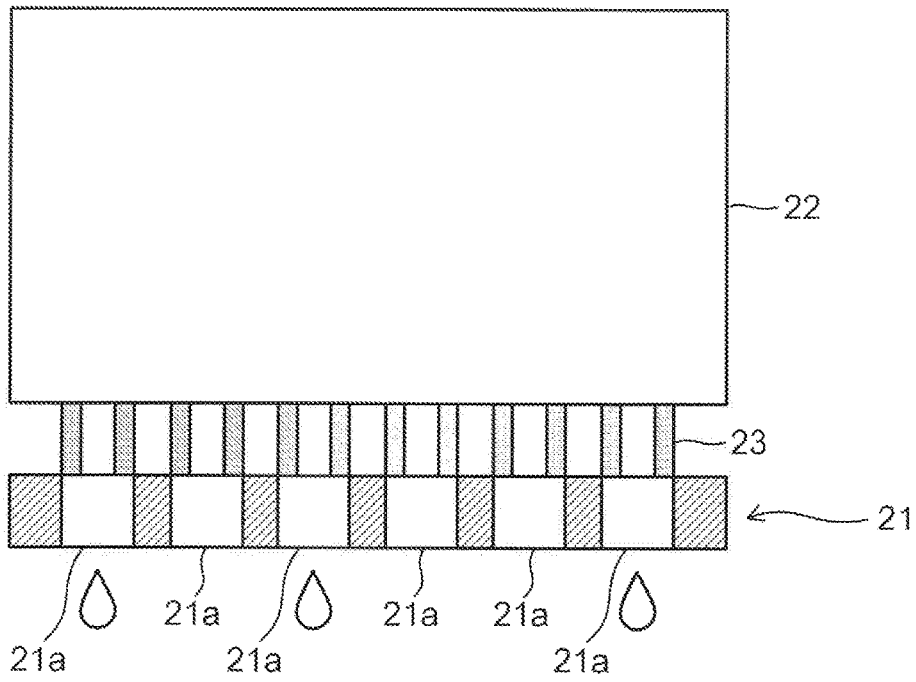
FIG. 3 is an illustrative diagram schematically showing ink supply paths for supplying ink to the inkjet head.

FIG. 3 is an illustrative diagram schematically showing ink supply paths in the inkjet head 21. Above the inkjet head 21, there is disposed a storage chamber 22 in which ink is stored. The inkjet head 21 has a plurality of channels 21*a* each of which is connected to the storage chamber 22 via two tubes 23. Each of the tubes 23 is provided with an unillustrated filter. When ink is ejected from the channels 21*a* of the inkjet head 21, ink stored in the storage chamber 22 is supplied to the channels 21*a* through the tubes 23. Here, the storage tank 8 and the ink tubes 10 shown in FIG. 1 may constitute the storage chamber 22 and the tubes 23, respectively.

As shown in FIG. 2, a plurality of (in the present embodiment, two) ink feeding holes 51, 52 are formed in the inkjet head 21 for supplying ink from the tubes 23 into the pressure chamber 31*a*.

The ink feeding hole 51 is an ink flow path formed through the insulating layer 42, the diaphragm 41, and the head substrate 31 over the first sub-chamber 31*b*. The ink feeding hole 51 communicates with the pressure chamber 31*a* via the first sub-chamber 31*b*. The ink feeding hole 52 is an ink flow path formed through the insulating layer 42, the diaphragm 41, and the head substrate 31 over the second sub-chamber 31*c*. The ink feeding hole 52 communicates with the pressure chamber 31*a* via the second sub-chamber 31*c*.

Sizes of the ink feeding holes 51, 52 are suitably set in accordance with specifications of a printer, the viscosity of ink, etc., and in the present embodiment, the opening diameters of the ink feeding holes 51, 52 are different from each other. More specifically, the opening diameter (diameter) of the ink feeding hole 51 is 30 μm, for example, and the opening diameter (diameter) of the ink feeding hole 52 is 10 μm, for example. Lengths of the flow paths of the ink feeding holes 51, 52 (that is, lengths in a direction parallel to the thickness direction of the head substrate 31) are the same.

Thus, the ink feeding holes 51, 52 have different opening diameters, and accordingly, the ink feeding holes 51, 52 have different flow-path resistances. The flow-path resistances indicate how difficult it is for a substance (ink) to flow through the ink feeding holes 51, 52. That is, as the opening diameters of the ink feeding holes 51, 52 become smaller or as the lengths of the flow paths of the ink feeding holes 51, 52 become longer, it becomes more difficult for ink to flow through the ink feeding holes 51, 52, and thus the flow-path resistances become larger. Furthermore, the flow-path resistances of the ink feeding holes 51, 52 each change in accordance with a speed at which the actuator 32 decompresses or pressurizes the inside of the pressure chamber 31*a* (a rate of change of volume of the pressure chamber 31*a*) such that the greater the speed of decompression or pressurization is (that is, the greater the rate of change of volume of the pressure chamber 31*a* is), the larger the flow-path resistances become. In the present embodiment, the flow-path resistances of the ink feeding holes 51, 52 change at different rates of change (the ink feeding holes 51, 52 have different rates of change of the flow-path resistance) with respect to change in speed of decompression or pressurization, such that the rate of change of the flow-path resistance is smaller (change of the flow-path resistance in response to change of the speed of the decompression or the pressurization is smaller) in the ink feeding hole 51 having a larger opening diameter than in the ink feeding hole 52 having a smaller opening diameter. Here, Japanese Patent Application Publication No. 2001-322099 (corresponding to U.S. Pat. No. 6,715,002) may be referred to, which describes, although not relating to an inkjet head, that the flow-path resistance changes in accordance as the pressure applied by an actuator changes.

In the present embodiment, when ink is not being ejected from the pressure chamber 31*a*, the driver circuit 46 generates, as the driving signal, a driving signal for circulating ink that is different from a driving signal for ejecting ink, and applies the generated driving signal for circulating ink to the actuator 32 to drive the actuator 32 to makes ink in the pressure chamber 31*a* circulate. Such circulation of ink helps reduce accumulation of air bubbles or foreign objects in the pressure chamber 31*a*, to avoid a situation where ink ejection is prevented by a clogged nozzle or pressure loss. A detailed description will now be given of the driving signal for ejecting ink and the driving signal for circulating ink, and also a description will be now given of ink ejecting and ink circulating operations based on the driving signals.

[Ink Ejecting Operation]

Figure 4:
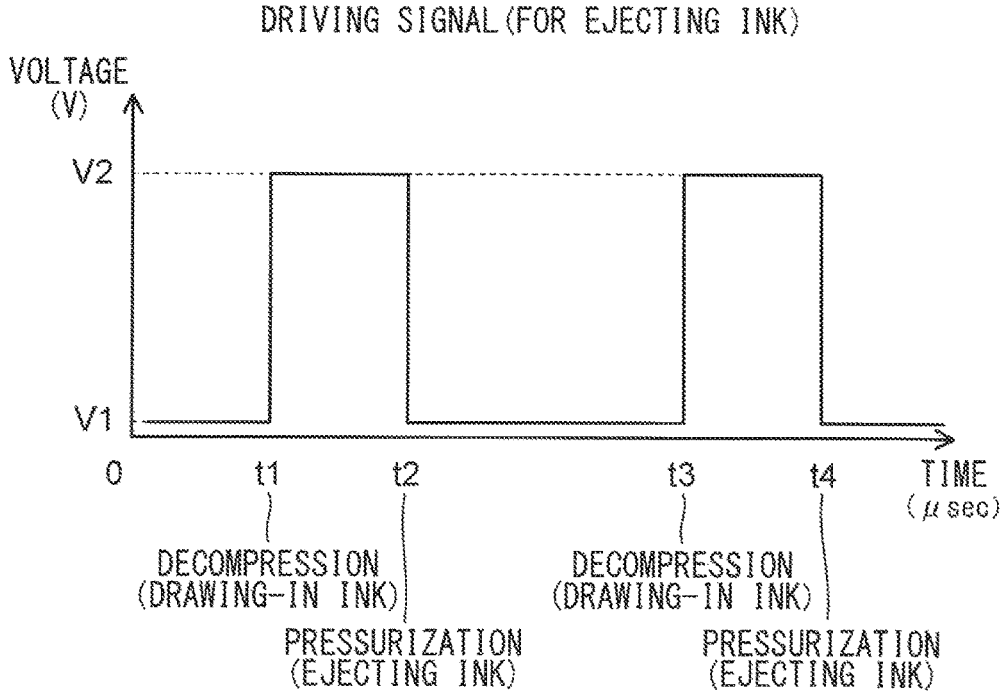
FIG. 4 is an illustrative diagram showing a waveform of a driving signal for ejecting ink.
Figure 5:
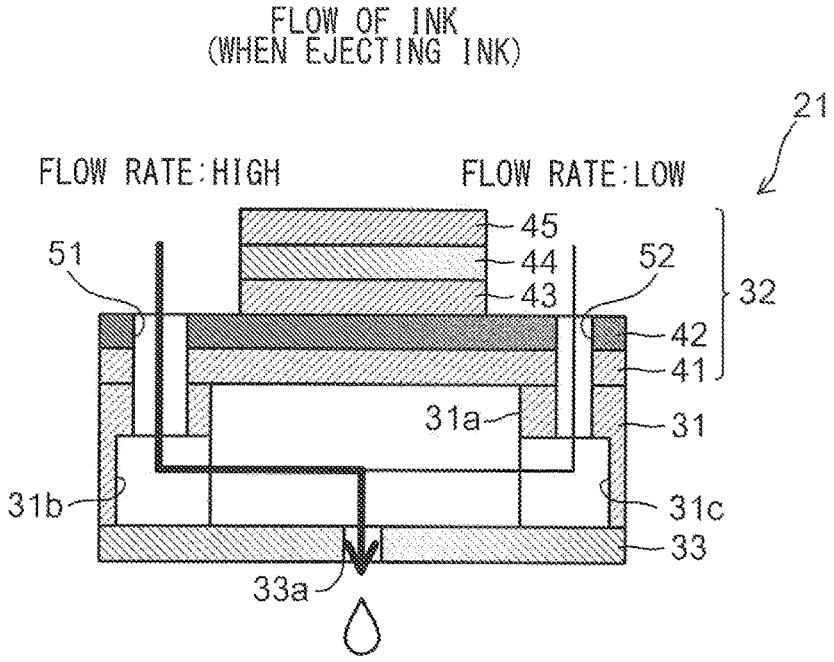
FIG. 5 is an illustrative diagram showing a flow of ink in the inkjet head when ink is ejected.

FIG. 4 shows a waveform of the driving signal for ejecting ink generated by the driver circuit 46, and FIG. 5 shows a flow of ink when ink is ejected. In ejecting ink, the driver circuit 46 applies the driving signal in a pulse form to the actuator 32. A pulse potential (application voltage), a pulse width (application time), and a pulse frequency of the driving signal depend on specifications of the printer or power of the actuator. In the present embodiment, for example, the application voltage is 20 V (a voltage V2 applied to the upper electrode is 20 V, a voltage V1 applied to the lower electrode is 0 V), the pulse width is 10 μsec (t2−t1=10 μsec), and the frequency is 10 kHz (t3−t1=100 μsec).

The voltage V2 is applied to the actuator 32 at time t1, and as a result, the piezoelectric body layer 44 expands in a direction perpendicular to its thickness direction, and the diaphragm 41 curves to be convex upward. This brings the inside of the pressure chamber 31 into a negative pressure state, as a result of which ink is drawn into the pressure chamber 31*a* via the ink feeding holes 51, 52.

At this time, a rise time of a pulse in the driving signal is close to zero, and the speed of deformation of the diaphragm 41 is high, and thus the speed of the decompression of the inside of the pressure chamber 31*a* becomes high. In this case, an extent to which the flow-path resistance of the ink feeding hole 52 increases is greater than an extent to which the flow-path resistance of the ink feeding hole 51 increases, and thus the difference between the flow-path resistances of the ink feeding holes 51, 52 becomes larger. As a result, difference in flow rate of ink between the ink feeding holes 51, 52 becomes larger (the flow rate is large in the ink feeding hole 51, and small in the ink feeding hole 52), and a flow amount of ink flowing through the ink feeding hole 51 becomes larger than a flow amount of ink flowing through the ink feeding hole 52.

Then, the voltage is lowered to V1 at time t2, and as a result, the piezoelectric body layer 44 recovers its original length, and the diaphragm 41 recovers its original flat state. Thereby, pressure is applied to the inside of the pressure chamber 31*a*, and thus ink inside the pressure chamber 31*a* is ejected outside via the nozzle hole 33*a* as ink droplets. At time t3 and time t4, too, ink is drawn in or ejected by application of the pulse to the actuator 32. Thereafter, the pulse is repeatedly applied to the actuator, and thereby ink is repeatedly drawn in and ejected.

[Ink Circulating Operation]

Figure 6:
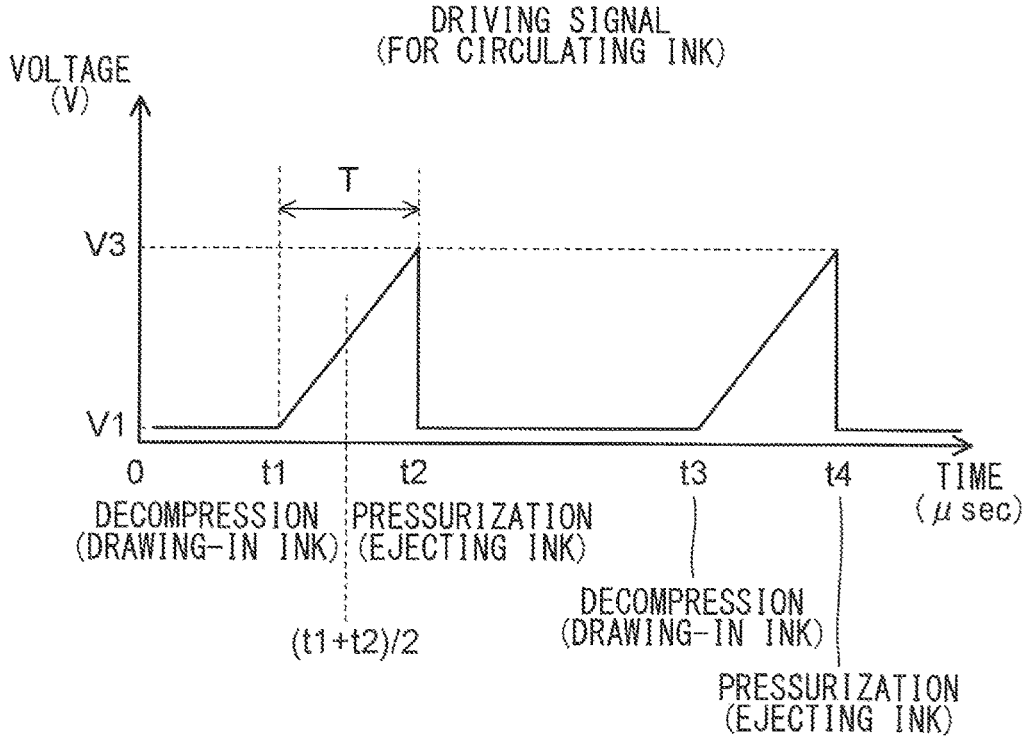
FIG. 6 is an illustrative diagram showing a waveform of a driving signal for circulating ink.
Figure 7:
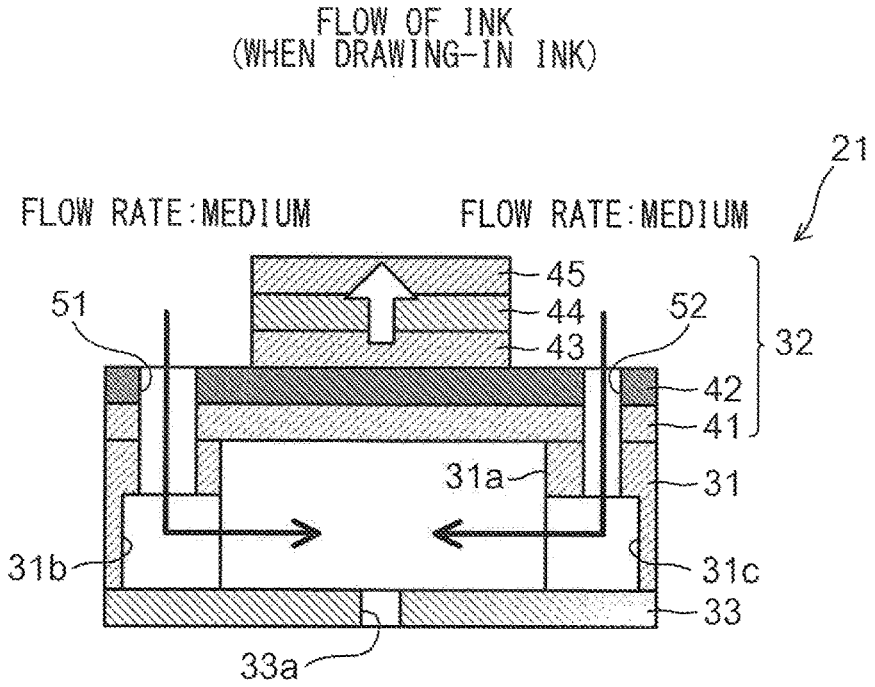
FIG. 7 shows an illustrative diagram showing a flow of ink in the inkjet head when ink is drawn in, and an illustrative diagram showing a flow of ink in the inkjet head when ink is discharged.
Figure 7:
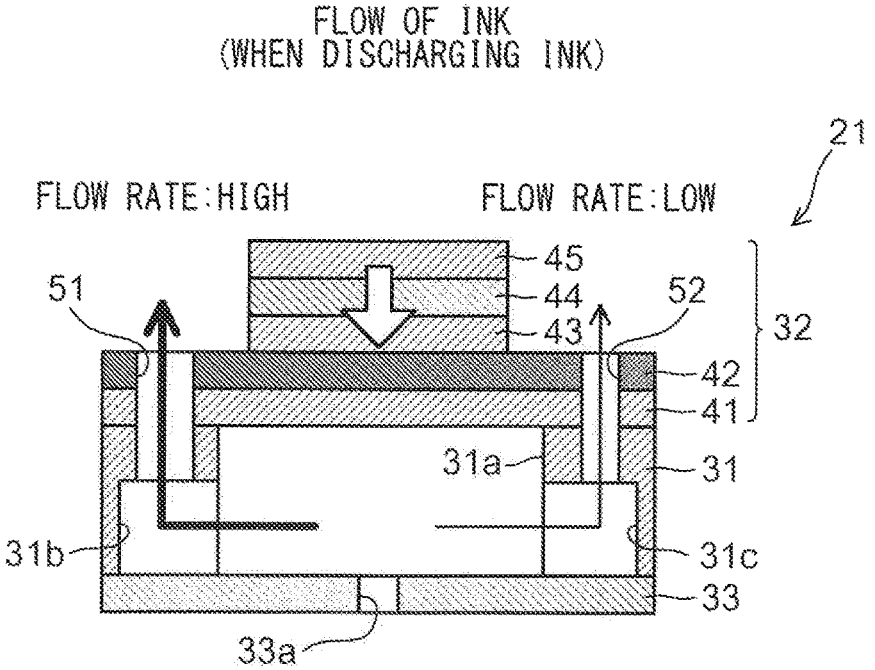

FIG. 6 shows a waveform of the driving signal for circulating ink. The driving signal for circulating ink is generated by the driver circuit 46. FIG. 7 shows a flow of ink when ink circulates (when ink is drawn in and discharged). To make the ink circulate, the driver circuit 46 applies the driving signal having a triangular waveform to the actuator 32. The driving signal has a waveform such that, in an application period T (μsec) in which one pulse is included, the application period T being a repetition unit in making ink in the pressure chamber 31*a* circulate, the waveform is asymmetrical between a side of a start of an application period T and a side of an end of the application period T, the start of the application period T corresponding to a start of decompression of the inside of the pressure chamber 31*a*, the end of the application period T corresponding to an end of pressurization of the inside of the pressure chamber 31*a*. More specifically, the driving signal has a waveform in which the rise time (t2−t1) and the fall time (≈0) of the pulse are different from each other, and the waveform is asymmetrical, with respect to a time point of (t1+t2)/2, between the side of the start of the application period T and the side of the end of the application period T.

The pulse potential (application voltage), the pulse width (application time), and the pulse frequency of the driving signal, which depend on physical characteristics of ink or power of an actuator, are set to values with which ink is not ejected. In the present embodiment, for example, the application voltage is 15 V (a voltage V3 applied to the upper electrode is 15 V, the voltage V1 applied to the lower electrode is 0 V), the pulse width is 100 μsec (t2−t1=100 μsec), and the frequency is 1 kHz (t3−t1=1000 μsec).

When a voltage is applied to the actuator 32 so as to continuously rise from V1 at time t1 to V3 at t2, the piezoelectric body layer 44 expands in a direction perpendicular to its thickness direction, to cause the diaphragm 41 to curve to be convex upward. This brings the inside of the pressure chamber 31 into a negative pressure state, as a result of which ink is drawn into the pressure chamber 31*a* via the ink feeding holes 51, 52.

At this time, the rise time of the pulse in the application period T is longer than when ink is ejected, and the speed of the deformation of the diaphragm 41 becomes lower, and thus the speed of the decompression of the inside of the pressure chamber 31*a* becomes lower. In this case, since the flow-path resistance of the ink feeding hole 52 does not increase so much as when ink is ejected, the difference between the flow-path resistances of the ink feeding holes 51, 52 is small, and thus the difference between flow rates of ink in the ink feeding holes 51, 52 is also small (the flow rate is medium in the ink feeding hole 51, and medium in the ink feeding hole 52). Thus, ink is drawn into the pressure chamber 31*a* through both of the ink feeding holes 51, 52.

Then, the voltage is lowered to V1 at time t2, and as a result, the piezoelectric body layer 44 recovers its original length, and the diaphragm 41 recovers its original flat state, and the inside of the pressure chamber 31*a* is pressurized. At this time, the fall time of the pulse at time t2 is close to zero, and thus the speed of the deformation of the diaphragm 41 becomes high, and the speed of the pressurization of the inside of the pressure chamber 31*a* becomes high. In this case, an extent to which the flow-path resistance of the ink feeding hole 52 increases is greater than an extent to which the flow-path resistance of the ink feeding hole 51 increases, and thus the difference between the flow-path resistances of the ink feeding holes 51, 52 becomes larger. As a result, difference in flow rate of ink between the ink feeding holes 51, 52 becomes larger (the flow rate is large in the ink feeding hole 51, and small in the ink feeding hole 52), and a flow amount of ink flowing through the ink feeding hole 51 becomes larger than a flow amount of ink flowing through the ink feeding hole 52. That is, more ink is discharged through the ink feeding hole 51 than through the ink feeding hole 52. At time t3 and time t4, too, ink is drawn in or discharged in the above manner by applying the above-described driving waveform to the actuator 32. Thereafter, the above operations are repeatedly performed to thereby draw in and discharge ink repeatedly, and as a result, ink in the pressure chamber 31*a* flows back into the storage chamber 22, and circulates.

For example, in a case where a ratio between a flow amount of ink drawn in through the ink feeding hole 51 and a flow amount of ink drawn in through the ink feeding hole 52 when ink is drawn into the pressure chamber 31*a* is 6:4, and a ratio between a flow amount of ink discharged through the ink feeding hole 51 and a flow amount of ink discharged through the ink feeding hole 52 when ink is discharged from the pressure chamber 31*a* is 8:2, ink of an amount corresponding to 2 as a remainder of (8−6=2) is discharged from the pressure chamber 31*a*, and ink of an amount corresponding to 2 as a remainder of (4−2=2) is drawn into the pressure chamber 31*a* through the ink feeding hole 52. That is, each time ink is drawn in and discharged, ink flows from the ink feeding hole 52 side to the ink feeding hole 51 side via the pressure chamber 31*a*. Thus, by repeating such drawing-in and discharging of ink, it is possible to make ink in the pressure chamber 31*a* circulate between the pressure chamber 31*a* and the storage chamber 22.

In the above example, when ink is drawn in, the difference between the flow amount of ink flowing through the ink feeding hole 51 and the flow amount of ink flowing through the ink feeding hole 52 corresponds to 2 obtained by subtracting 4 from 6, and when ink is discharged, the difference between the flow amount of ink flowing through the ink feeding hole 51 and the flow amount of ink flowing through the ink feeding hole 52 corresponds to 6 obtained by subtracting 2 from 8, and this indicates that the difference between the flow amounts of ink changes between when ink is drawn into the pressure chamber 31*a* and when ink is discharged from the pressure chamber 31*a*. Thus, it can also be said that ink is allowed to circulate by the change in difference between the flow amounts of ink flowing through the ink feeding holes 51, 52 between when ink is drawn into the pressure chamber 31*a* and when ink is discharged from the pressure chamber 31*a*.

Here, although FIG. 6 shows a case where the rise time of the pulse is longer than the fall time of the pulse in the driving signal for circulating ink, but instead, there may be applied to the actuator 32 a driving signal in which the rise time of the pulse is shorter than the fall time of the pulse. In this case, it is possible to make ink circulate in a direction reverse to the direction in the above-described case (that is, it is possible to make ink circulate from the ink feeding hole 51 toward the ink feeding hole 52 via the pressure chamber 31*a*).

Figure 8:
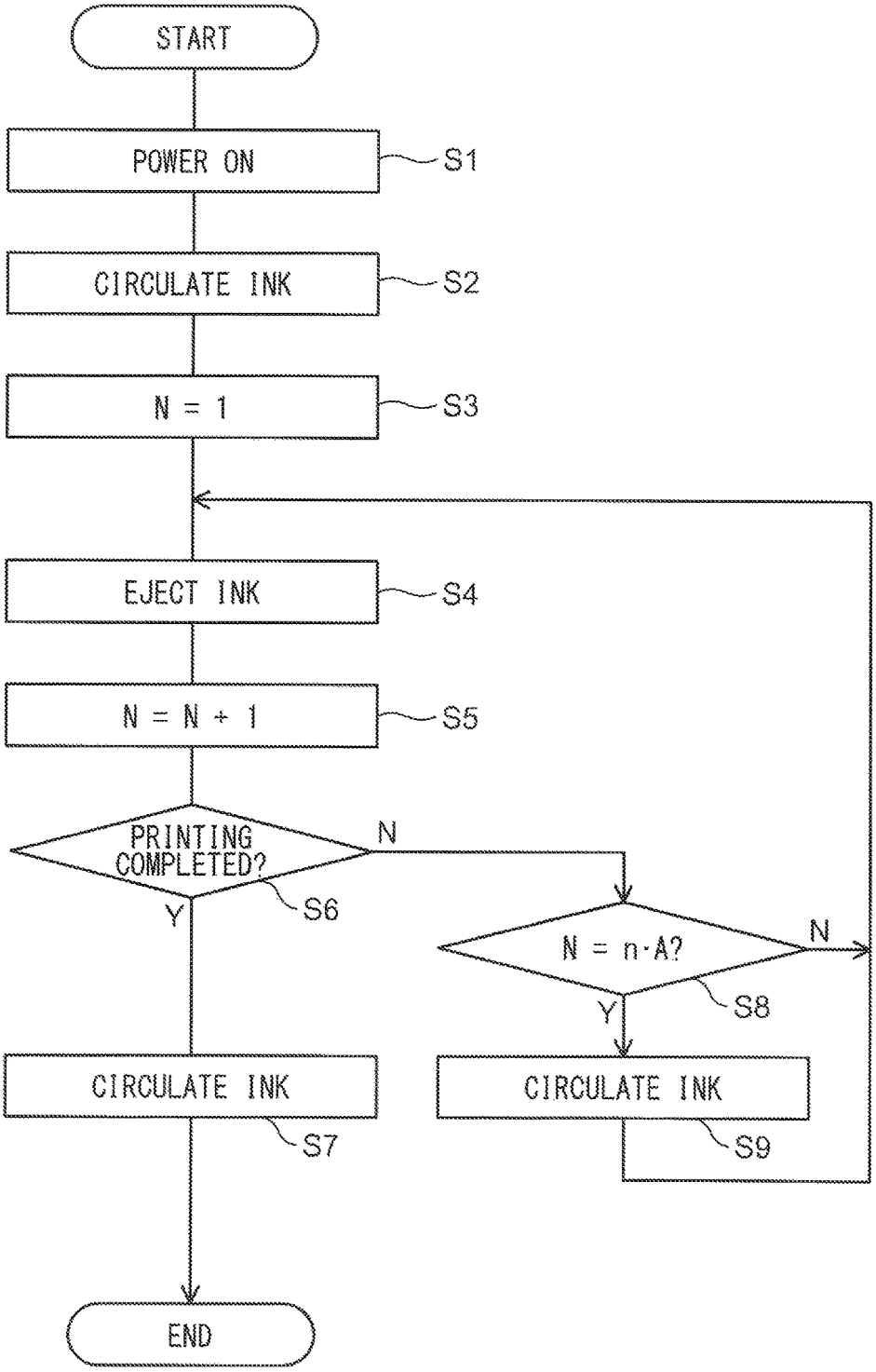
FIG. 8 is a flow chart showing an example of a flow of operations performed in the inkjet head.

The ink circulating operation described above can be performed at the following timing, for example. FIG. 8 is a flow chart showing an example of a flow of operations performed in the inkjet head 21 of the present embodiment.

First, when the inkjet printer 1 is turned ON (S1), the above-described ink circulating operation is performed (S2), and subsequently a number N of sheets to be printed is set to N=1 (S3), and then the above-described ink ejecting operation is performed (S4). Then, the number N is increased by 1 (N+1) (S5), and a control unit (unillustrated) judges whether or not printing has been completed to a last page (S6). In S6, when the printing is judged to have been completed, the ink circulating operation is performed again (S7), and the series of operations are ended.

On the other hand, in S6, when the printing is judged not to have been completed, the unillustrated control unit judges, with respect to the number N of printed sheets, whether or not N=n−A holds, where "n" represents a natural number and "A" represents a predetermined number of sheets (for example 50 sheets) (S8). In S8, when it is judged that N=n·A does not hold (that is, when it is judged that the number of printed sheets has not reached a predetermined number), the control unit judges that there is no need of circulating ink, and returns the procedure back to S4 to repeat the operations from S4. On the other hand, in S8, when it is judged that N=n·A holds (that is, when it is judged the number of printed sheets has reached the predetermined number), the control unit, assuming that the printing on the predetermined number of sheets has generated air bubbles or foreign objects that need to be removed, performs the ink circulating operation (S9) and then returns the procedure back to S4 to repeat the operations from S4.

As has been discussed above, according to the present embodiment, the flow-path resistances of the ink feeding holes 51, 52 of the inkjet head 21 are different from each other, and the flow-path resistances each change in accordance with the speed of the decompression or the pressurization of the pressure chamber 31*a* by the actuator 32. With this configuration, when ink is not being ejected from the pressure chamber 31*a*, by the actuator 32 repeating the decompression and the pressurization of the inside of the pressure chamber 31*a* at different speeds based on the driving signal for circulating ink, it is possible to make degrees of difficulty for ink to flow through the ink feeding holes 51, 52 change between when ink is caused to be drawn into the pressure chamber 31*a* by the decompression of the inside of the pressure chamber 31*a* and when ink is caused to be discharged from the pressure chamber 31*a* by the pressurization of the inside of the pressure chamber 31*a*, to thereby make the flow amounts of ink (and also the difference between the flow amounts of ink) that flows through the ink feeding holes 51, 52 change between when ink is caused to be drawn into the pressure chamber 31*a* by the decompression of the inside of the pressure chamber 31*a* and when ink is caused to be discharged from the pressure chamber 31*a* by the pressurization of the inside of the pressure chamber 31*a*. Thus, by repeating the drawing-in and the discharging of ink in this manner, it is possible to make ink in the pressure chamber 31*a* circulate via the ink feeding holes 51, 52.

Thus, when ink is not being ejected, it is possible to make ink in the pressure chamber 31*a* circulate by using the actuator 32, which is an existing actuator, and this eliminates the need of providing a dedicated control mechanism for circulating ink besides the actuator 32 for the purpose of removing foreign objects or air bubbles from the pressure chamber 31*a*. This makes it possible to avoid increase in size and cost of inkjet heads. Moreover, even where an increased number of pressure chambers 31*a* are used to support higher-speed printing, since there is no need of providing a dedicated control mechanism for circulating ink, no problem arises of increase in size and cost of such a control mechanism. Thus, it is possible to increase the number of pressure chambers 31*a*, and easily support higher-speed printing.

Moreover, since ink is made to circulate by making use of the difference in speed between the decompression of the inside of the pressure chamber 31*a* and the pressurization of the inside of the pressure chamber 31*a* (that is, the difference in flow amount of ink flowing through each of the ink feeding holes 51, 52 between when ink is drawn in and when ink is discharged), even where the pressure chamber 31*a* is formed small to achieve higher-resolution printing, there is no need of such high pressure as in a case where pressure in one direction is applied to ink to make the ink circulate. This helps reduce trouble liable to be caused in the head or the flow path if high pressure is applied to circulate ink, and as a result, it is possible to form the pressure chamber 31*a* small, and easily achieve higher-resolution printing.

Moreover, the driving signal for circulating ink has a waveform that is asymmetrical between the side of the start of the application period T (ink drawing-in side) and the side of the end of the application period T (ink discharging side), and by applying such a driving signal to the actuator 32 to decompress or pressurize the inside of the pressure chamber 31*a*, it is possible to make the speed of the decompression and the speed of the pressurization differ from each other. This surely makes the flow-path resistances of the ink feeding holes 51, 52 change between when ink is drawn into the pressure chamber 31*a* by the decompression and when ink is discharged from the pressure chamber 31*a* by the pressurization, and as a result, it is possible to surely make the flow amounts of ink flowing through the ink feeding holes 51, 52 change between when ink is drawn into the pressure chamber 31*a* and when ink is discharged from the pressure chamber 31*a*, to surely make ink in the pressure chamber circulate via each of the ink feeding holes 51, 52.

Moreover, since the rise time and the fall time of the pulse in the application period T of the driving signal for circulating ink are different from each other, it is possible to achieve a driving waveform that is surely asymmetrical in a time-axis direction in the application period T. Thus, by driving the actuator 32 based on the driving signal, it is possible to perform the decompression and the pressurization of the inside of the pressure chamber 31*a* at different speeds, and surely make ink in the pressure chamber 31*a* to circulate.

Moreover, since the ink feeding holes 51, 52 have different opening diameters, it is possible to surely realize a configuration essential for making ink circulate by application of the asymmetrical driving signal, that is, a configuration where the flow-path resistances of the ink feeding holes 51, 52 are different from each other, and also a configuration where the flow-path resistances of the ink feeding holes 51, 52 each change in accordance with the speed of the decompression or the pressurization of the inside of the pressure chamber 31*a* performed by the actuator 32.

Moreover, since the actuator 32 is a piezoelectric actuator and has the diaphragm 41, the lower electrode 43, the piezoelectric body layer 44, and the upper electrode 45, it is possible to obtain the advantages of the present embodiment with a configuration that uses such a piezoelectric actuator. Furthermore, since piezoelectric actuators are advantageous in that they have large output and high responsiveness, for example, it is possible to achieve a high-performance inkjet head 21.

[Other Configurations of Inkjet Head]

Figure 9:
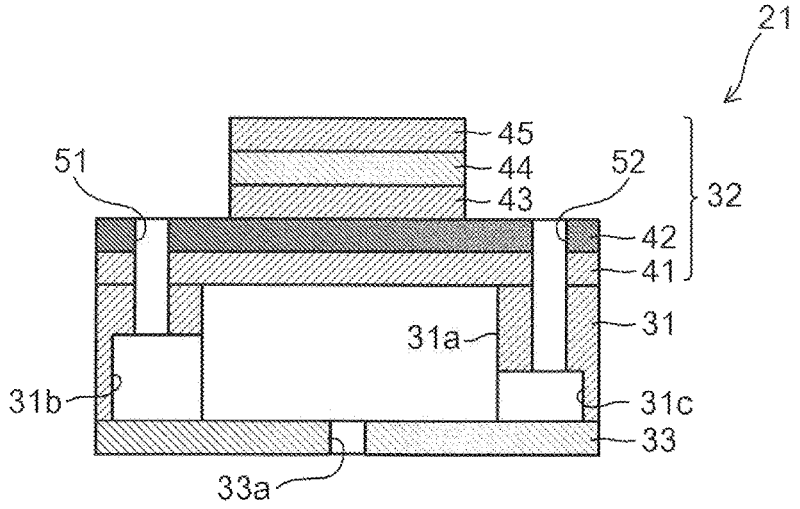
FIG. 9 is a sectional view showing another configuration of the inkjet head.

FIG. 9 is a sectional view showing another configuration of the inkjet head 21 of the present embodiment. Instead of having different opening diameters, the ink feeding holes 51, 52 of the inkjet head 21 may have different flow-path lengths and have the same opening diameter. In FIG. 9, the ink feeding hole 51 has a shorter flow length than the ink feeding hole 52, and the flow-path resistance of the ink feeding hole 51 is smaller than the flow-path resistance of the ink feeding hole 52. In addition, the rate of change of the flow-path resistance in response to the change of the speed of the decompression or the pressurization is smaller in the ink feeding hole 51 having a shorter flow-path length than in the ink feeding hole 52.

Even in the case where the ink feeding holes 51, 52 have different flow-path lengths in this manner, it is possible to achieve the configuration where the ink feeding holes 51, 52 have different flow-path resistances, and further, it is possible to surely realize a configuration where the flow-path resistances are made to change in accordance with the speed of decompression or pressurization of the inside of the pressure chamber 31*a* by the actuator 32.

Figure 10:
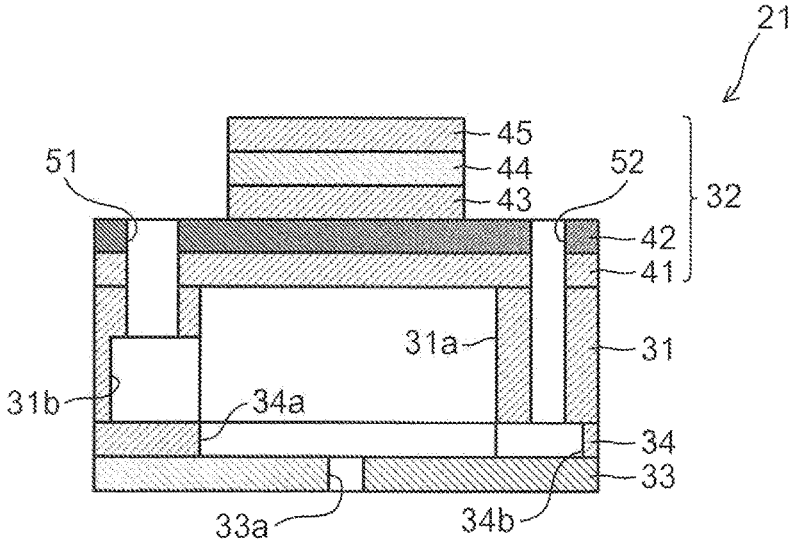
FIG. 10 is a sectional view showing still another configuration of the inkjet head.

FIG. 10 is a sectional view showing still another configuration of the inkjet head 21 of the present embodiment. As shown in the figure, flow-path resistances of the ink feeding holes 51, 52 may be made different from each other by forming the ink feeding holes 51, 52 to have different opening diameters and different flow-path lengths. Alternatively, one of the ink feeding holes 51, 52 that has a larger flow-path resistance (that is, the ink feeding hole 52 in the example shown in FIG. 10) may be formed all through the head substrate 31 in its thickness direction, and the head substrate 31 may be joined with the nozzle substrate 33 via an intermediate substrate 34. Here, for the purpose of achieving communication between the pressure chamber 31*a* and the nozzle hole 33*a*, the following are formed in the intermediate substrate 34: an opening 34*a* having a same sectional shape as the pressure chamber 31*a*; and a communication path 34*b* via which the opening 34*a* and the ink feeding hole 52 communicate with each other.

In the configuration of FIG. 10, in the ink circulating operation, a side of the ink feeding hole 51 having a smaller flow-path resistance becomes an ink discharging side and a side of the ink feeding hole 52 having a larger flow-path resistance becomes an ink drawing-in side. Here, an end (an end opposite from the storage chamber 22 side) of the ink feeding hole 52 on the ink drawing-in side is disposed close to the nozzle hole 33*a* of the nozzle substrate 33, and this makes it possible to efficiently make ink around the nozzle hole 33*a* circulate to thereby efficiently remove air bubbles or foreign objects around the nozzle hole 33*a* while ink is being circulated.

[Other Waveforms of Driving Signal for Circulating Ink]

Figure 11:
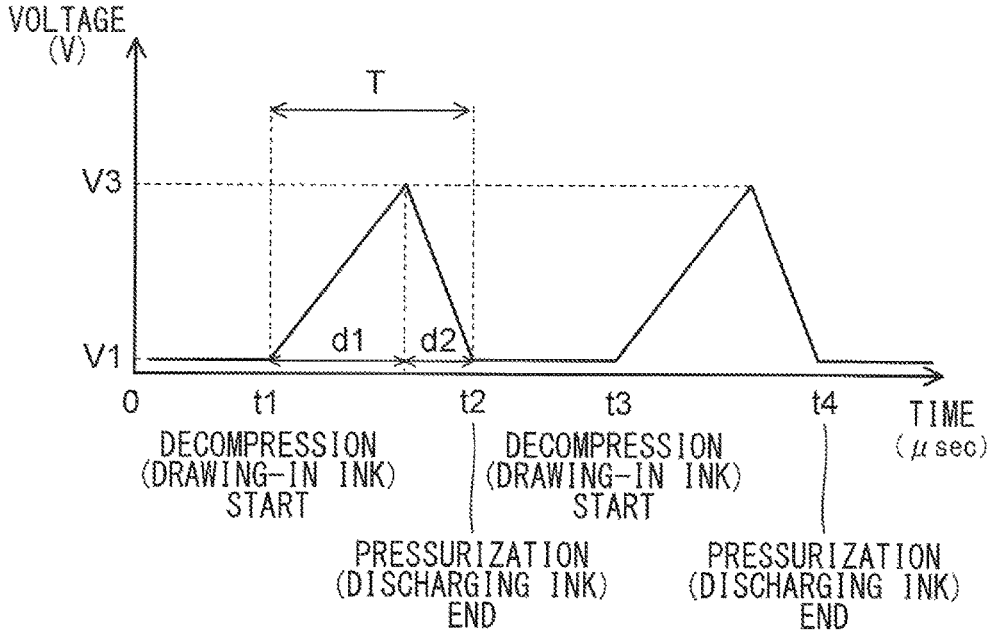
FIG. 11 is an illustrative diagram showing another waveform of the driving signal for circulating ink.
Figure 12:
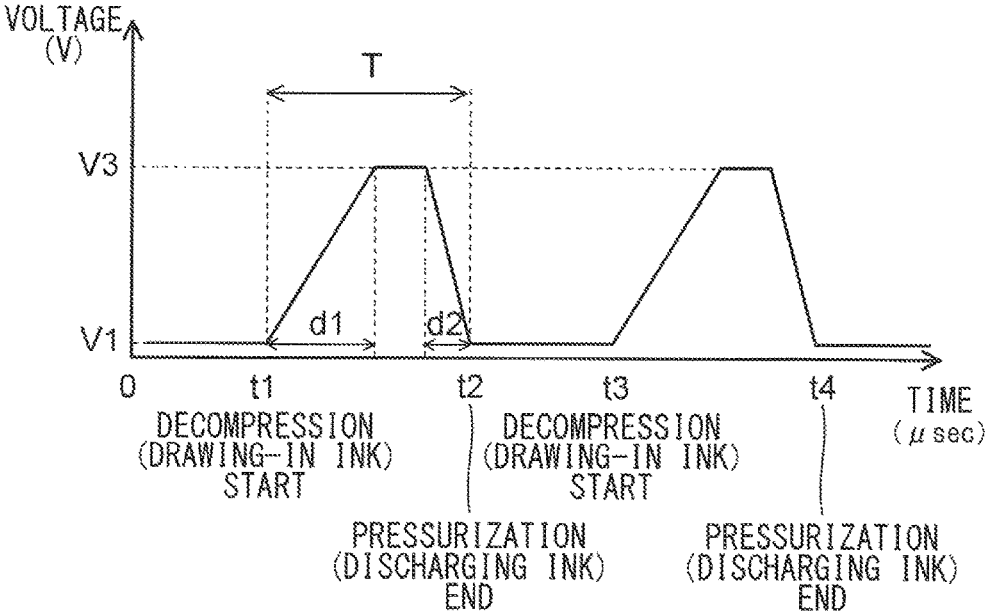
FIG. 12 is an illustrative diagram showing still another waveform of the driving signal for circulating ink.

FIG. 11 is an illustrative diagram showing another waveform of the driving signal for circulating ink, and FIG. 12 is an illustrative diagram showing a still another waveform of the driving signal for circulating ink. In a case where only one pulse is included in the application period T of the driving signal, as long as the driving signal has a waveform in which the rise time d1 (μsec) and the fall time d2 (μsec) of the pulse are different from each other (when the waveform is asymmetrical between a pulse rising side and a pulse falling side), the pulse may be a triangular wave as shown in FIG. 11, or may be a trapezoidal wave as shown in FIG. 12.

Figure 13:
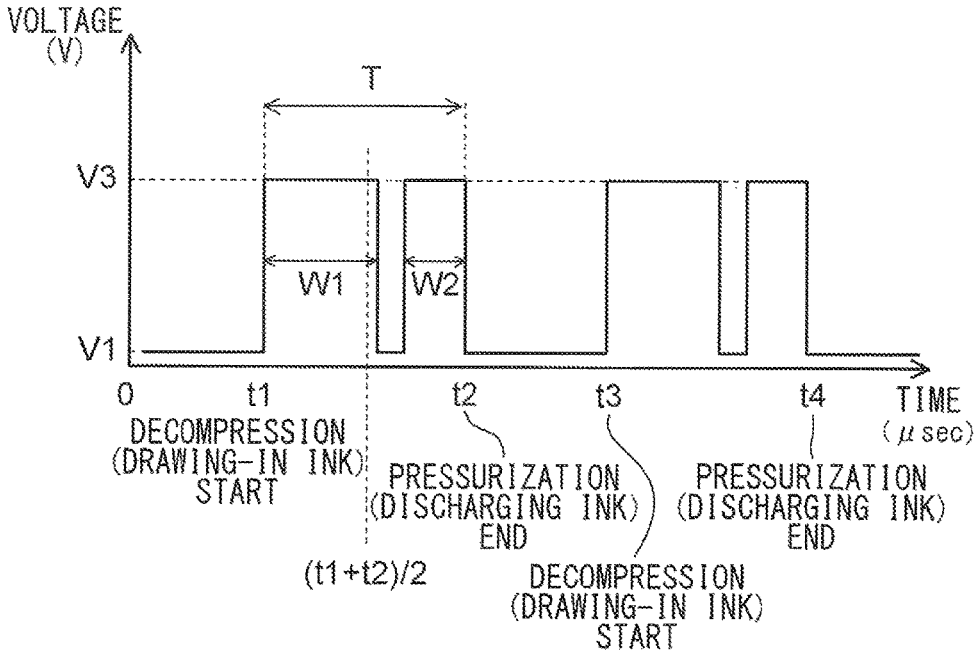
FIG. 13 is an illustrative diagram showing still another waveform of the driving signal for circulating ink.
Figure 14:
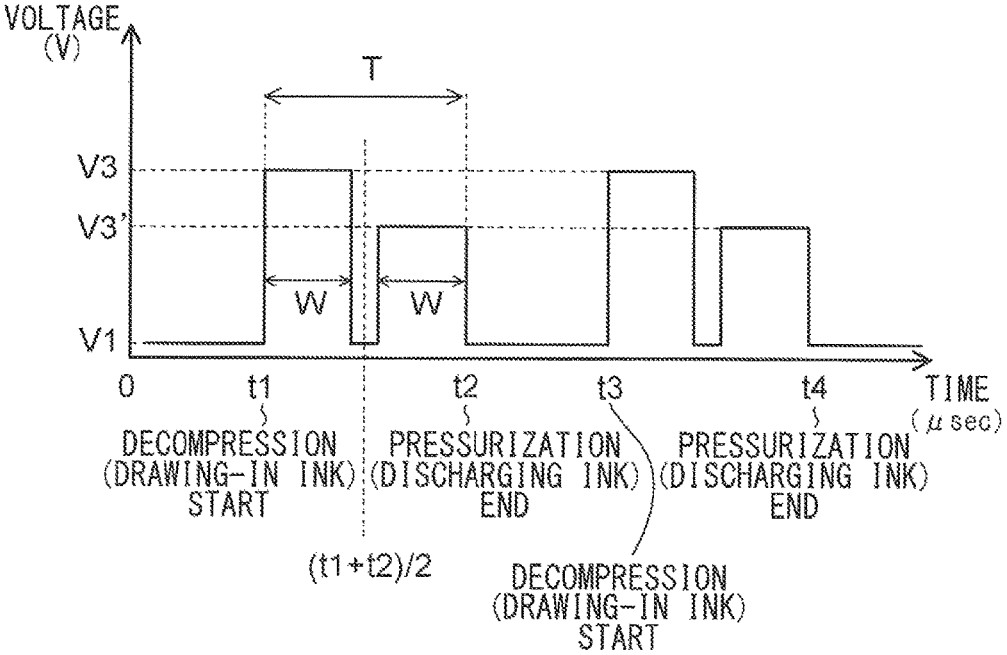
FIG. 14 is an illustrative diagram showing still another waveform of the driving signal for circulating ink.
Figure 15:
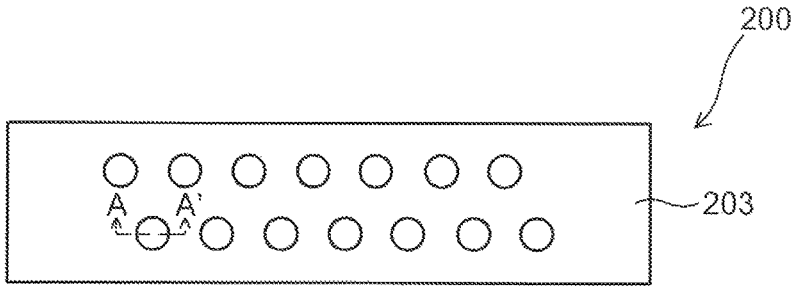
FIG. 15 shows a plan view showing a general configuration of an inkjet head including a conventional piezoelectric actuator, and a sectional view taken along line A-A' in the plan view.
Figure 15:
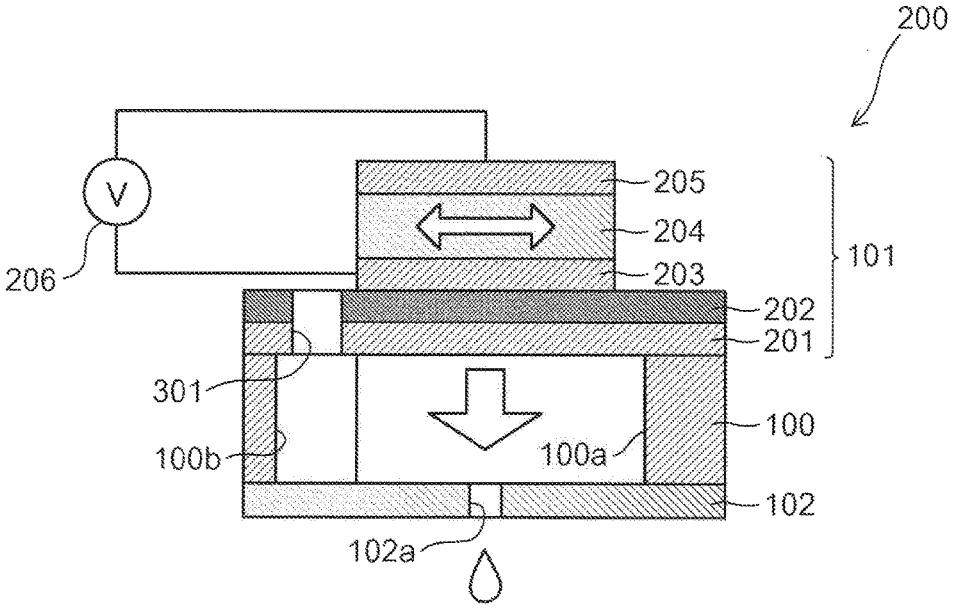

FIG. 13 and FIG. 14 are each an illustrative diagram showing still another waveform of the driving signal for circulating ink. A plurality of pulses may be included in the application period T of the driving signal. In this case, the driving signal may have a waveform in which the plurality of pulses included in the application period T are different from each other in pulse width, or a waveform in which the plurality of pulses included in the application period T are different from each other in pulse potential. For example, in FIG. 13, two pulses are included in the application period T, and the widths W1 and W2 of the two pulses are different from each other (for example, W1>W2). On the other hand, in FIG. 14, two pulses are included in the application period T, and the potentials V3 and V3' of the two pulses are different from each other (for example, V3>V3'). In FIG. 14, the two pulses in the application period T have the same width W, but the two pulses may have different widths like the two pulses shown in FIG. 13.

In each of these cases, too, as seen in the entire application period T, the waveform of the driving signal is asymmetrical, based on the time point (t1+t2)/2, between the side of the start of the application period T (ink drawing-in side) and the side of the end of the application period T (ink discharging side). Thus, also by driving the actuator 32 based on such a driving signal, it is possible to make ink in the pressure chamber 31*a* circulate.

More specifically, in whichever of the driving signals shown in FIG. 13 and FIG. 14, the two pulses included in the application period T as a whole can be taken as substantially equivalent to a pulse that rapidly rises at time t1 and slowly falls over a period from a middle of the application period T through time t2. Thus, also when the actuator 32 is driven based on such a driving signal, the speed of the decompression on the side of the start of the application period T and the speed of the pressurization on the side of the end of the application period T are different from each other, and thus it is possible to make the flow amounts of ink flowing through the ink feeding holes 51, 52 change between when ink is drawn into the pressure chamber 31*a* and when ink is discharged from the pressure chamber 31*a*, and thus to make ink in the pressure chamber 31*a* circulate via the ink feeding holes 51, 52.

Here, also in a case where three or more pulses are included in the application period T, by making the three or more pulses differ from each other in pulse width or pulse potential, it is possible to achieve a waveform that is asymmetrical between the side of the start of the application period and the side of the end of the application period.

The inkjet head of the present embodiment can also be expressed as follows. That is, the inkjet head of the present embodiment is a pressure-type inkjet head that makes an actuator apply pressure to ink in a pressure chamber and thereby ejects the ink from the pressure chamber, and the inkjet head includes a plurality of ink feeding holes through which ink is supplied into the pressure chamber, and a driver circuit that generates a driving signal for driving the actuator; the plurality of ink feeding holes have different flow-path resistances that each change in accordance with the speed of decompression or pressurization of the inside of the pressure chamber performed by the actuator; when ink is not being ejected from the pressure chamber, the driver circuit generates, as the driving signal, a driving signal for circulating ink, which differs from a driving signal for ejecting ink, and applies the driving signal for circulating ink to the actuator; and the actuator makes ink in the pressure chamber circulate by making a flow amount of ink flowing through each of the plurality of ink feeding holes differ between when ink is drawn into the pressure chamber and when ink is discharged from the pressure chamber, by repeating the decompression and the pressurization of the inside of the pressure chamber at different speeds based on the driving signal for circulating ink.

[Others]

In the present embodiment, the flow-path resistances of the plurality of ink feeding holes 51, 52 are made different from each other by forming the ink feeding holes 51, 52 to have different opening diameters or different flow-path lengths, but instead, the flow-path resistances of the ink feeding holes 51, 52 may be made different from each other by, for example, disposing an obstacle such as a filter in one of the ink feeding holes 51, 52.

The present embodiment has been described dealing with a case where 2 is the number of ink feeding holes communicating with one pressure chamber 31*a*; however, also with three or more ink feeding holes, it is possible to make ink in the pressure chamber 31*a* circulate by making the flow-path resistances of at least two of the ink feeding holes different from each other.

In the present embodiment, ink is made to circulate at least immediately before printing is started and after al the printing is completed, and in addition, ink is made to circulate also when the number of printed sheets has reached a predetermined value (that is, also during a non-printing interval that is between the completion of printing on the predetermined number of sheets and the start of printing on a next sheet), but instead, ink may be made to circulate in an interval corresponding to a non-printing-pixel section of one sheet.

The present embodiment has been described dealing with a case where a piezoelectric actuator is adopted as an example of pressure-type actuator; however, also with any other pressure-type actuators such as electrostatic, magnetic, and thermal-deformation actuators, by applying the driving method of the present embodiment, it is possible to obtain the same advantages as obtained with the present embodiment.

The inkjet head and the inkjet printer of the present embodiment described above can be expressed as follows, and exert the following operations and effects.

The inkjet head of the present embodiment is a pressure-type inkjet head that makes an actuator apply pressure to ink in a pressure chamber and thereby ejects the ink from the pressure chamber, and the inkjet head includes a plurality of ink feeding holes through which ink is supplied into the pressure chamber, and a driver circuit that generates a driving signal for driving the actuator; the plurality of ink feeding holes have different flow-path resistances; when ink is not being ejected from the pressure chamber, the driver circuit generates, as the driving signal, a driving signal for circulating ink, which differs from a driving signal for ejecting ink, and applies the driving signal for circulating ink to the actuator; and by being driven based on the driving signal for circulating ink, the actuator makes ink in the pressure chamber circulate by making a flow amount of ink flowing through each of the plurality of ink feeding holes differ between when ink is drawn into the pressure chamber and when ink is discharged from the pressure chamber.

Since the flow-path resistances of the ink feeding holes are different from each other, when the actuator is driven based on the driving signal for circulating ink when ink is not being ejected from the pressure chamber, the degree of difficulty for ink to flow through each of the ink feeding holes differs between when ink is drawn into the pressure chamber and when ink is discharged from the pressure chamber. Thereby, it is possible to make the flow amount of ink flowing through each of the ink feeding holes change between when ink is drawn into the pressure chamber and when ink is discharged from the pressure chamber, and this makes it possible to make ink in the pressure chamber circulate via each of the ink feeding holes.

Thus, when ink is not being ejected, the ink is made to circulate by driving (making use of) the actuator for ink ejection, the need is eliminated of separately providing, outside the head, a dedicated control mechanism for circulating ink for the purpose of removing foreign objects or air bubbles from the inside of the pressure chamber. Thus, it is possible to avoid increase in size and cost of the head, unlike with the conventional configuration provided with the control mechanism as mentioned above. Since the above-mentioned control mechanism is not required, even if the number of the pressure chamber is increased to support higher-speed printing, problems of increase in size and cost of the control mechanism do not arise. This makes it easy to increase the number of the pressure chamber to support higher-speed printing.

Furthermore, ink is made to circulate by making use of the difference in flow amount of ink flowing through each of the ink feeding holes between when ink is drawn into the pressure chamber and when ink is discharged from the pressure chamber, and this eliminates the need of application of such high pressure as in a case where ink is pressurized in one direction to circulate. Thus, even in a case where the pressure chamber is formed small for higher-resolution printing, it is possible to reduce trouble liable to happen in the head or the flow path if high pressure is applied to circulate ink. Thus, it is possible to form the pressure chamber small to achieve higher-resolution printing with ease.

It is preferable that, in an application period in which at least one pulse is included, the application period being a repetition unit in making ink in the pressure chamber circulate, a waveform of the driving signal for circulating ink be asymmetrical between a side of a start of the application period and a side of an end of the application period, the start of the application period corresponding to a start of decompression of an inside of the pressure chamber, the end of the application period corresponding to an end of pressurization of the inside of the pressure chamber.

When the driving signal for circulating ink, which has a waveform asymmetrical in the application period, is applied to the actuator to decompress or pressurize the inside of the pressure chamber, the difference between the speeds of the decompression and the pressurization of the inside of the pressure chamber during the application period surely makes the flow-path resistance of each of the ink feeding holes change between when ink is drawn into the pressure chamber by the decompression of the inside of the pressure chamber and when ink is discharged from the pressure chamber by the pressurization of the inside of the pressure chamber, and as a result, it is possible to surely make the flow amount of ink flowing through each of the ink feeding holes change between when ink is drawn into the pressure chamber and when ink is discharged from the pressure chamber. This helps surely make ink in the pressure chamber circulate via each of the ink feeding holes.

In a case where only one pulse is included in the application period, the driving signal for circulating ink may have a waveform in which a rise time of the pulse and a fall time of the pulse are different from each other.

In this case, the pulse included in the application period has a waveform that is asymmetrical between the pulse rise side and the pulse fall side, and by driving the actuator based on such a driving signal, it is possible to make the speeds of the decompression and the pressurization of the inside of the pressure chamber differ from each other, to thereby make ink in the pressure chamber circulate.

In the case where a plurality of pulses are included in the application period, the driving signal for circulating ink may have a waveform in which the plurality of pulses included in the application period are different from each other in pulse width or pulse potential.

Even in the case where the driving signal for circulating ink is such that a plurality of pulses are included in the application period, by making the pulses differ from each other in pulse width or pulse potential, a waveform asymmetrical between the side of the start of the application period and the side of the end of the application period is achieved in the entire application period. Thus, also by driving the actuator based on the driving signal, it is possible to make the speeds of the decompression and the pressurization of the inside of the pressure chamber differ from each other, to thereby make ink in the pressure chamber circulate.

Opening diameters of the plurality of ink feeding holes may be different from each other. In this case, it is possible to securely achieve a configuration in which the plurality of ink feeding holes have different flow-path resistances from each other.

Flow-path lengths of the plurality of ink feeding holes may be different from each other. In this case as well, it is possible to surely achieve a configuration in which the flow-path resistances of the plurality of ink feeding holes are different from each other.

The actuator may include a piezoelectric body layer, two electrodes that are disposed such that the piezoelectric body layer is sandwiched between the two electrodes, and through which the driving signal for ejecting ink or the driving signal for circulating ink is applied to the piezoelectric body layer, and a diaphragm that decompresses or pressurizes the inside of the pressure chamber by vibrating along with displacement of the piezoelectric body layer caused by application of the driving signal to the piezoelectric body layer. With a configuration using such a piezoelectric actuator, it is possible to obtain the advantages described above.

The inkjet printer of the present embodiment includes the inkjet head described above. There is no need of providing, outside the head, a dedicated control mechanism for circulating ink for the purpose of removing foreign objects or air bubbles from the pressure chamber of the head, and this makes it possible to avoid increase in size and cost. Moreover, it is possible to achieve an inkjet printer capable of easily supporting faster and higher-resolution printing.

INDUSTRIAL APPLICABILITY

A pressure-type inkjet head of the present invention is applicable to an inkjet printer.

LIST OF REFERENCE SIGNS

1 inkjet printer
21 inkjet head
31*a* pressure chamber
32 actuator
41 diaphragm
43 lower electrode
44 piezoelectric body layer
45 upper electrode
46 driver circuit
51 ink feeding hole
52 ink feeding hole

The invention claimed is:

1. A pressure-type inkjet head that makes an actuator apply pressure to ink in a pressure chamber and thereby ejects the ink from the pressure chamber, the inkjet head comprising:

a plurality of ink feeding holes through which ink is supplied into the pressure chamber; and a driver circuit that generates a driving signal for driving the actuator, wherein the plurality of ink feeding holes have different flow-path resistances, when ink is not being ejected from the pressure chamber, the driver circuit generates, as the driving signal, a driving signal for circulating ink which differs from a driving signal for ejecting ink, and applies the driving signal for circulating ink to the actuator, and by being driven based on the driving signal for circulating ink, the actuator makes ink in the pressure chamber circulate by making a flow amount of ink flowing through each of the plurality of ink feeding holes differ between when ink is drawn into the pressure chamber and when ink is discharged from the pressure chamber, wherein, in an application period in which at least one pulse is included, the application period being a repetition unit in making ink in the pressure chamber circulate, a waveform of the driving signal for circulating ink is asymmetrical between a side of a start of the application period and a side of an end of the application period, the start of the application period corresponding to a start of decompression of an inside of the pressure chamber, the end of the application period corresponding to an end of pressurization of the inside of the pressure chamber, and wherein, in a case where a plurality of pulses are included in the application period, the driving signal for circulating ink has a waveform in which the plurality of pulses included in the application period are different from each other in pulse width or pulse potential.

2. The inkjet head according to claim 1, wherein opening diameters of the plurality of ink feeding holes are different from each other.

3. The inkjet head according to claim 1, wherein flow-path lengths of the plurality of ink feeding holes are different from each other.

4. The inkjet head according to claim 1, wherein the actuator includes a piezoelectric body layer, two electrodes that are disposed such that the piezoelectric body layer is sandwiched between the two electrodes, and through which the driving signal for ejecting ink or the driving signal for circulating ink is applied to the piezoelectric body layer, and a diaphragm that decompresses or pressurizes the inside of the pressure chamber by vibrating along with displacement of the piezoelectric body layer caused by application of the driving signal to the piezoelectric body layer.

5. An inkjet printer comprising the inkjet head according to claim 1.

6. A method for driving a pressure-type inkjet head that makes an actuator apply pressure to ink in a pressure chamber and thereby ejects the ink from the pressure chamber, the inkjet head comprising a plurality of ink feeding holes through which ink is supplied into the pressure chamber and a driver circuit that generates a driving signal for driving the actuator, the plurality of ink feeding holes having different flow-path resistances, the method comprising:

generating at the driver circuit, when ink is not being ejected from the pressure chamber, as the driving signal, a driving signal for circulating ink which differs from a driving signal for ejecting ink the driver circuit generates, and applying the driving signal for circulating ink to the actuator, and circulating ink in the pressure chamber by driving the actuator based on the driving signal for circulating ink to make a flow amount of ink flowing through each of the plurality of ink feeding holes differ between when ink is drawn into the pressure chamber and when ink is discharged from the pressure chamber, wherein, in an application period in which at least one pulse is included, the application period being a repetition unit in making ink in the pressure chamber circulate, a waveform of the driving signal for circulating ink is asymmetrical between a side of a start of the application period and a side of an end of the application period, the start of the application period corresponding to a start of decompression of an inside of the pressure chamber, the end of the application period corresponding to an end of pressurization of the inside of the pressure chamber, and wherein, in a case where a plurality of pulses are included in the application period, the driving signal for circulating ink has a waveform in which the plurality of pulses included in the application period are different from each other in pulse width or pulse potential.

7. The method for driving an inkjet head according to claim 6, wherein opening diameters of the plurality of ink feeding holes are different from each other.

8. The method for driving an inkjet head according to claim 6, wherein flow-path lengths of the plurality of ink feeding holes are different from each other.

* * * * *